US005580292A

United States Patent [19]

Gaportsin

[11] Patent Number: 5,580,292

[45] Date of Patent: Dec. 3, 1996

[54] TOY BANK

[76] Inventor: Iosif Gaportsin, 820 E. 10 St. #4J, Brooklyn, N.Y. 11230

[21] Appl. No.: 519,150

[22] Filed: Aug. 21, 1995

[51] Int. Cl.[6] ..... A45C 1/12; A63H 3/14

[52] U.S. Cl. ..... 446/8; 446/304; 446/329

[58] Field of Search ..... 446/329, 327, 446/304, 305, 395, 8, 9, 10, 301

[56] References Cited

U.S. PATENT DOCUMENTS

| | | | |
|---|---|---|---|
| 961,812 | 6/1910 | Siegel | 446/329 |
| 1,751,773 | 3/1930 | Trosper | 446/304 |
| 2,530,032 | 11/1950 | Schier et al. | 446/304 |
| 2,995,865 | 8/1961 | Kiscadden | 446/73 |
| 3,992,805 | 11/1976 | Arkin | 446/8 |
| 4,345,400 | 8/1982 | Katzman et al. | 446/10 |
| 5,117,507 | 6/1992 | Long | 446/329 X |
| 5,135,421 | 8/1992 | Morris | 446/8 |

*Primary Examiner*—Mickey Yu
*Attorney, Agent, or Firm*—Ilya Zborovsky

[57] ABSTRACT

A toy bank has a body part having a mouth-forming area provided with an introducing slot, the mouth-forming area having an immovable portion and a movable portion which is movable relative to the immovable portion between an open position in which the mouth-forming area imitates an open mouth and the introducing slot is exposed for introducing money, and a closed position in which the mouth-forming area imitates a closed mouth and the introducing slot is not exposed.

5 Claims, 3 Drawing Sheets

TOY BANK

BACKGROUND OF THE INVENTION

The present invention relates generally to toy banks.

Toy banks are known in the art and produced in many modifications. Usually, a toy bank or piggy bank is an immovable container which has an opening for introducing money through the opening so that they can accumulate inside the container. The container also has a removing opening which is usually closed, but can be opened by a user after a certain amount of money has been accumulated in the container. Since the known toy banks are usually immovable and do not have movable parts, their attractiveness especially to kids is relatively low. It is to be understood that the existing toy banks can be further improved.

SUMMARY OF THE INVENTION

Accordingly, it is an object of the present invention to provide a toy bank which is a further improvement of the existing toy banks and is more attractive to kids and to adults as well.

In keeping with these objects and with others which will become apparent hereinafter, one feature of the present invention resides, briefly stated, in a toy bank which is formed as a figure imitating a human or an animal and having a mouth forming part provided with an introducing slot, a container cooperating with said introducing slot so that money introduced through the introducing slot fall into the container, and a movable part formed for example as a art of the head such as a jaw or the like movable between a closed position in which a mouth is closed and the introducing opening cannot be reached and an open position in which the mouth and therefore the introducing opening are exposed so that money can be introduced into said introducing opening through the open mouth.

When the toy bank is designed in accordance with the present invention it is more attractive for kids and adults. A kid for example who wants to get some money from adults can perform movements of the movable part of the toy bank imitating mouth movements begging for food, in the open position of the device the mouth is open and people can introduce money through the introducing opening into the money bank and thereafter the mouth can be closed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
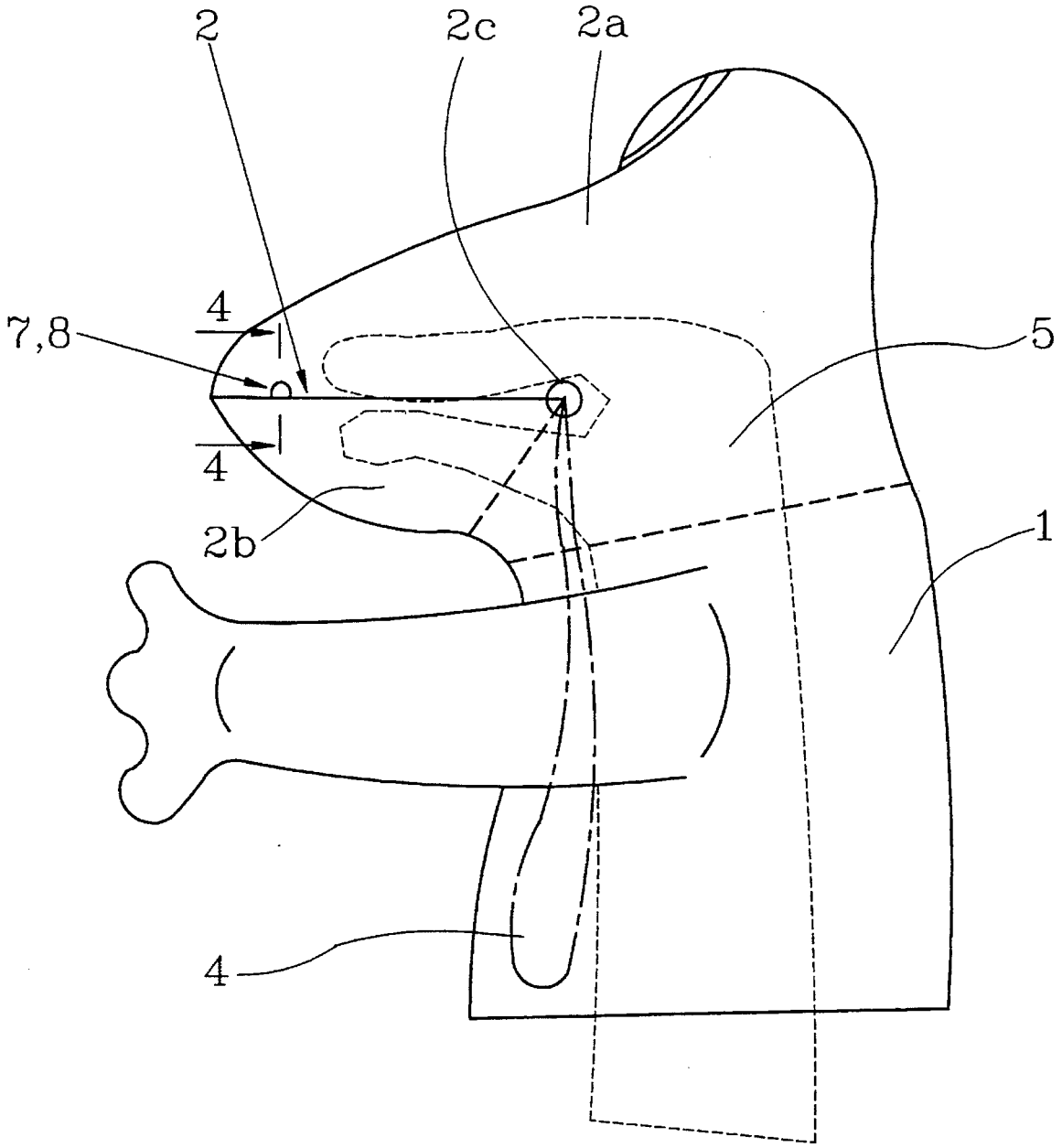
FIG. 1 is a side view of a toy bank in accordance with the present invention in a closed position.
Figure 2:
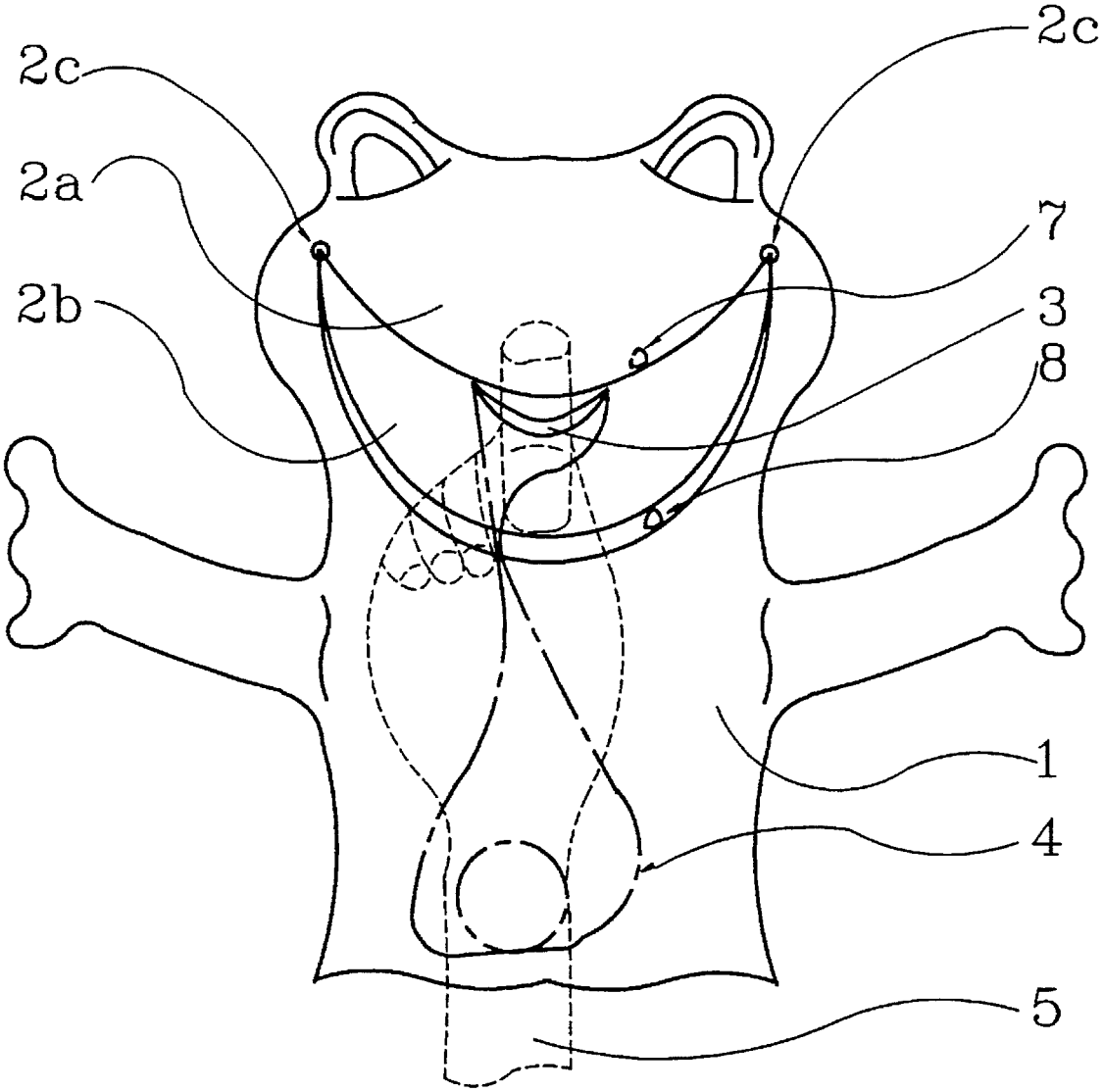
FIG. 2 is a front view of the toy bank of the present invention in an open position.
Figure 3:
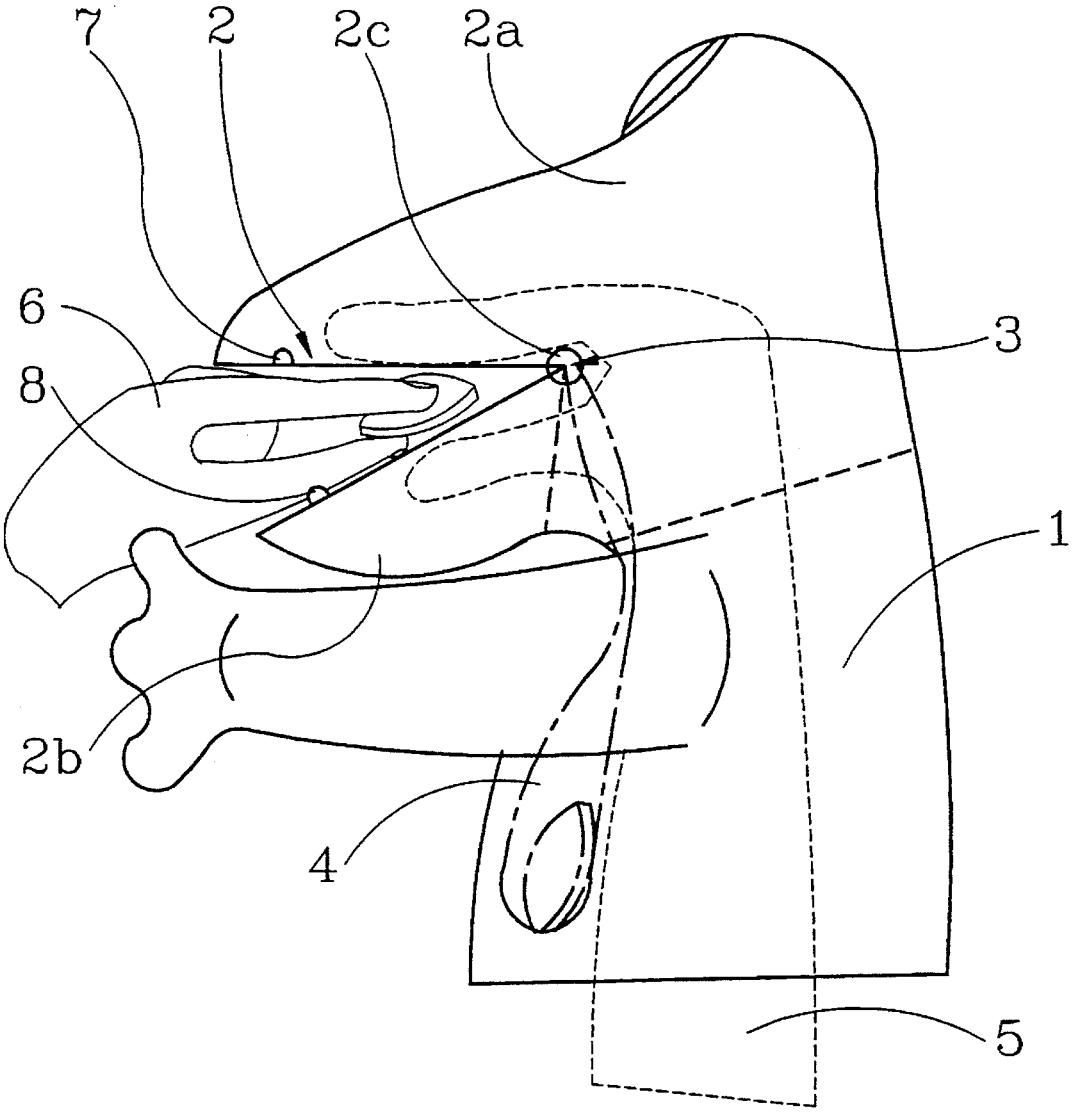
FIG. 3 is a side view of the inventive toy bank in the open position.
Figure 4:
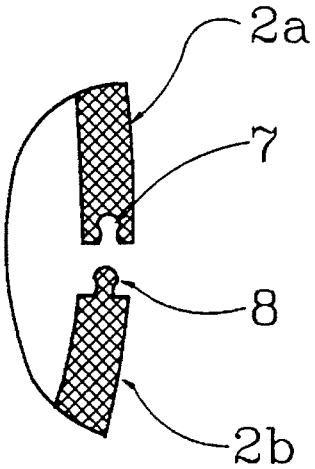
FIG. 4 is a view showing parts of the inventive toy bank in the area of their interengagement.

A toy bank in accordance with the present invention is illustrated as embodied in a frog figure toy bank. The toy bank has a body which is identified as a whole with reference numeral 1. A mouth is identified as a whole with reference numeral 2. It has an upper part 2*a* which is immovably connected with the body part 1 and a lower part 2*b* which is movable relative to the upper part for example because of two hinges 2*c*. The body 1 can be formed for example of cardboard and covered with a fabric. An introducing slot 3 is provided in the mouth area 2 of the toy bank. It is arranged deep inside the mouth of the frog of the toy bank of the present invention.

A container formed for example as an elastic bag 4 is attached to the body 1 in its interior so that an opening of the bag communicates with the introducing slot 3. The container can be connected to the body by known means, for example by glueing, clamps and etc. When the container is filled with money it can be disconnected from the body in particular from the introducing slot 3 by tearing the container in the region of its opening from the body 1.

The toy bank in accordance with the present invention operates in the following manner. An owner of the toy bank can hold the toy bank on his arm which is identified with reference numeral 5. In particular, one finger can be introduced into an area of the upper mouth-forming part 2*a*, while another finger can be introduced in the area of the lower mouth-forming part 2*b*. In the area of the lower mouth-forming part 2*b*, the owner's finger can just push aside the elastic bag 4 to fit his finger into this part. The owner thereby holds the piggy bank and moves with his finger the lower mouth-forming part 2*b* to imitate mouth movements which are usually performed when an animal or a human asks for food. This is the open position of the toy bank. In this open position of the toy bank when the mouth of the frog is open, a person with his hand identified with reference numeral 6 can insert a coin into the introducing slot 3. Then, the mouth of the mouth is closed by the owner by pushing his finger introduced into the lower mouth-forming area 2*b* upwardly.

In order to hold the mouth in the closed position, the mouth-forming parts 2*a* and 2*b* can be provided with a groove 7 and a projection 8 correspondingly which are engageable with one another with elastic action. The elastic action can be produced since the material of the mouth-forming area 2 is elastic plastic. In order to obtain the closed position shown in FIG. 1, the lower mouth-forming portion 2*b* is pressed outwardly toward tile upper mouth-forming portion 2*a*, and the projection 8 elastically engages in the groove 7 and holds the portions together. Opening of the mouth can be performed by a simple downward movement of the mouth-forming portion 2*b* by the owner of the piggy bank and the projection disengages from the groove. The projection 8 of the lower mouth-forming part 2*b* disengages from the upper mouth-forming part 2*a*.

It will be understood that each of the elements described above, or two or more together, may also find a useful application in other types of constructions differing from the types described above.

While the invention has been illustrated and described as embodied in a toy bank, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A toy bank, comprising a hollow body part which is open from below for introducing a user's hand and has a mouth-forming area defined by an upper piece of material and a lower piece of material joined at their inner ends, an introducing slot formed in one of said upper or lower piece of material, said mouth-forming area having an immovable portion with respect to said body and a movable portion which is movable by a user's finger relative to said immovable portion between an open position in which said mouth-forming area imitates an open mouth and said introducing slot is exposed for introducing money, and a closed position in which said mouth-forming area imitates a closed mouth and said introducing slot is not exposed; and a container located in an interior of said hollow body part and having an opening, said container being connected directly to said introducing slot of said mouth-forming area of said body so that said opening of said container is connected to said introducing slot, said container being elastic so that it can be pushed aside by a user's finger when a user moves by the finger said movable portion relative to said immovable portion.

2. A toy bank as defined in claim 1, wherein said movable portion of said mouth-forming area is pivotable relative to the immovable portion of said mouth-forming area; and further comprising means for pivotally connecting said portions with one another.

3. A toy bank as defined in claim 2, wherein said means for pivotally connecting said portions with one another includes at least two hinges provided at two sides of said mouth-forming area and pivotally connecting said movable relative to said immovable relative.

4. A toy bank as defined in claim 1, wherein said portions are located one above the other and include an upper portion which forms said immovable portion and a lower portion which forms said movable portion and is movable by a user's finger downwardly from said upper immovable portion and upwardly toward said upper immovable portion.

5. A toy bank, comprising a hollow body part which is open from below for introducing a user's hand and has a mouth-forming area defined by an upper piece of material and a lower piece of material joined at their inner ends, an introducing slot formed in one of said upper or lower piece of material, said mouth-forming area having an immovable portion with respect to said body and a movable portion which is movable by a user's finger relative to said immovable portion between an open position in which said mouth-forming area imitates an open mouth and said introducing slot is exposed for introducing money, and a closed position in which said mouth-forming area imitates a closed mouth and said introducing slot is not exposed; a container located in an interior of said hollow body part and having an opening, said container being connected directly to said introducing slot of said mouth-forming area of said body so that said opening of said container is connected to said introducing slot, said container being elastic so that it can be pushed aside by a user's finger when a user moves by the finger said movable portion relative to said immovable portion; and means for retaining said portions of said mouth-forming area in said closed position, said retaining means including an uninterrupted groove provided in one of said portions of said mouth-forming area of said body and an uninterrupted projection provided in another of said portions of said mouth-forming part and elastically engageable and disengageable from said uninterrupted groove by applying a force to said movable portion from the interior of said body.

* * * * *